United States Patent [19]

Hehmann et al.

[11] Patent Number: 4,770,850

[45] Date of Patent: Sep. 13, 1988

[54] MAGNESIUM-CALCIUM-NICKEL/COPPER ALLOYS AND ARTICLES

[75] Inventors: Franz J. Hehmann, Osnabruck, Fed. Rep. of Germany; Setumadhavan Krishnamurthy, Dayton; Erica Robertson, Fairborn, both of Ohio; Steven J. Savage, Stockholm, Sweden; Francis H. Froes, Xenia, Ohio

[73] Assignee: The United States of America as represented by the Secretary of the Air Force, Washington, D.C.

[21] Appl. No.: 103,137

[22] Filed: Oct. 1, 1987

[51] Int. Cl.[4] ..... C22C 23/00; B22F 3/14

[52] U.S. Cl. ..... 420/402; 75/249; 419/48; 419/49

[58] Field of Search ..... 420/402; 75/249; 419/48, 49, 67

[56] References Cited

U.S. PATENT DOCUMENTS

| | | | |
|---|---|---|---|
| 2,124,557 | 7/1938 | Gann | 420/402 |
| 2,221,245 | 11/1940 | Hanawalt et al. | 420/402 |
| 2,233,008 | 2/1941 | Henawalt et al. | 420/402 |
| 2,823,996 | 2/1958 | Gardner | 420/402 |
| 4,439,379 | 3/1984 | Hart | 264/12 |
| 4,460,407 | 7/1984 | Keith | 420/590 |

FOREIGN PATENT DOCUMENTS

| | | | |
|---|---|---|---|
| 144991 | 1/1962 | U.S.S.R. | 420/402 |

*Primary Examiner*—Melvyn J. Andrews
*Assistant Examiner*—Robert L. McDowell
*Attorney, Agent, or Firm*—Donald J. Singer; Thomas L. Kundert; Charles E. Bricker

[57] ABSTRACT

A novel magnesium alloy consisting essentially of about 6 to 14 weight percent calcium, about 4 to 8 weight percent of copper or nickel, balance magnesium.

There is also provided a process for producing a magnesium alloy article having improved properties which comprises the steps of providing a rapidly solidified product having the composition defined above and having a maximum average thickness of about 200 microns in at least one dimension, introducing the rapidly solidified product into a mold, and consolidating the rapidly solidified product to obtain a desired densification of the rapidly solidified product. Consolidation may be carried out by hot isostatic pressing (HIP'ing) the rapidly solidified product at a pressure of about 100 to 300 MPa and a temperature of about 150° to 350° C. for a time sufficient to obtain the desired densification. Alternatively, consolidation may be accomplished by extrusion using the same temperature range, and an extrusion ratio of about 10:1 to 30:1.

10 Claims, No Drawings

MAGNESIUM-CALCIUM-NICKEL/COPPER ALLOYS AND ARTICLES

RIGHTS OF THE GOVERNMENT

The invention described herein may be manufactured and used by or for the Government of the United States for all governmental purposes without the payment of any royalty.

BACKGROUND OF THE INVENTION

This invention relates to magnesium base alloys. In one aspect this invention relates to novel magnesium base alloys. In another aspect this invention relates to an improved process for fabricating a magnesium article.

Magnesium alloys are widely used for structural applications. In the aircraft industry, magnesium alloys have been used for fuselages, engine parts, and landing wheels. In the automobile industry, magnesium alloys have been used in such parts as the engine crankcase, transmission housing, fan housing and gearbox. Magnesium alloys are best known for their light weight and high strength-to-weight ratio. Accordingly, they are used generally in application where weight is a critical factor and where high mechanical integrity is required.

It is an object of the present invention to provide a magnesium alloy article having improved properties.

It is another object of the present invention to provide a process for producing a magnesium alloy article having improved properties.

It is a further object of the present invention to provide novel magnesium alloys.

Other objects and advantages of the present invention will be readily apparent to those skilled in the art.

DESCRIPTION OF THE INVENTION

In accordance with the present invention, there is provided a novel alloy consisting essentially of about 6 to 14 weight percent calcium, about 4 to 8 weight percent of copper or nickel, balance magnesium.

Also, in accordance with the present invention, there is provided a process for producing a magnesium alloy article having improved properties which comprises the steps of providing a rapidly solidified product having the composition defined above and having a maximum average thickness of about 200 microns in at least one dimension, introducing the rapidly solidified product into a mold, and consolidating the rapidly solidified product to obtain a desired densification of the rapidly solidified product. Consolidation may be carried out by hot isostatic pressing (HIP'ing) the rapidly solidified product at a pressure of about 100 to 300 MPa and a temperature of about 150° to 350° C. for a time sufficient to obtain the desired densification. Alternatively, consolidation may be accomplished by extrusion using the same temperature range, and an extrusion ratio of about 10:1 to 30:1.

Further, in accordance with the present invention, there is provided an article fabricated as described above.

The alloys of this invention are prepared using a suitable rapid solidification technique. Initially, an alloy melt is prepared by melting together, with mixing, magnesium, about 6 to 14 weight percent calcium, and about 4 to 8 weight percent copper or nickel. The rapidly-solidified material may be produced either directly from the alloy melt or by casting the melt into a suitable shape for later production of the rapidly-solidified material.

The rapidly-solidified material may be produced using any known technique which provides a cooling rate of at least about $10^3$ $KS^{-1}$ and which produces a product having a maximum average thickness of about 200 microns. Suitable production techniques include gas atomization, ultrasonic gas atomization, close coupled gas atomization, drum splat, centrifugal rapid solidification, twin roll atomization, piston and anvil, twin piston, electron beam splat quenching, chill block melt spinning, planar flow casting, melt drag, crucible melt extraction, and pendant drop melt extraction. The preferred production techniques are those which provide a rapidly solidified product of smooth, spherical powder form.

The rapidly-solidified material may be consolidated by various methods such as by hot isostatic pressing (HIP'ing), vacuum hot pressing (VHP'ing) or extrusion. In the HIP'ing process, pressure and temperature are applied simultaneously inside an autoclave allowing full density to be obtained. Production of complex shapes is possible using a metal can of ceramic mold. The metal can is shaped to a desired configuration by conventional sheet-metal methods. The ceramic mold process relies basically on the technology developed by the investment casting industry in that molds are prepared by the lost-wax process. Other molding techniques known in the art may also be employed. The VHP process involves hot compaction of powder in a forge press adapted to a vacuum system in which dies designed to produce the desired shape press the material to full density. The consolidated article may be forged, machined or otherwise worked to produce a finished article. The extrusion of rapidly solidified material involves degassing and canning of the as-produced material or preforms obtained by cold or hot pressing of the material, heating the can(s) and forcing the heated can(s) through dies having extrusion ratios in the range of 10:1 to 30:1.

The following example illustrates the invention:

EXAMPLE

A series of Mg-Ca-Cu and Mg-Ca-Ni alloys were prepared containing 6–14 wt. percent Ca and 6 (nominal) wt percent Cu or Ni. Twin-piston quenched splats were prepared from each alloy. Each alloy was also cast into a chilled mold. The cast material was aged at room temperature for 45 days prior to measuring the Knoop hardness. The splatted material was aged 35 days at room temperature. The heat-treated samples were stored at room temperature for two days, heat treated, then aged at room temperature for 30 days.

| Composition (wt %) | | | | Knoop Hardness Number | | | Heat Treatment Conditions | |
|---|---|---|---|---|---|---|---|---|
| Mg | Ca | Cu | Ni | Cast | Splat | Heat-treated Splat | Temp(a C.) | Time(hr) |
| 88.0 | 6.0 | 6.0 | — | 79 | 142.9 ± 6.6 | 157.4 ± 8.8 | 100 | 1 |

-continued

| Composition (wt %) | | | | Knoop Hardness Number | | | Heat Treatment Conditions | |
|---|---|---|---|---|---|---|---|---|
| Mg | Ca | Cu | Ni | Cast | Splat | Heat-treated Splat | Temp(a C.) | Time(hr) |
| 83.5 | 10.5 | 6.0 | — | 84 | 174.2 ± 15.8 | 186.6 ± 28.5 | 200 | 1 |
| 80.0 | 14.0 | 6.0 | — | 98 | 201.6 ± 43.2 | 278.2 ± 23.7 | 200 | 1 |
| 88.4 | 6.0 | — | 5.6 | 99 | 213.6 ± 15.7 | — | — | — |
| 83.9 | 10.5 | — | 5.6 | 85 | 220.9 ± 13.3 | 245.4 ± 28.2 | 150 | 1 |
| 80.4 | 14.0 | — | 5.6 | 107 | 246.3 ± 48.9 | 265.2 ± 41 | 200 | 1 |

Various modifications may be made without departing from the spirit and scope of the present invention.

We claim:

1. A magnesium alloy consisting essentially of about 6 to 14 weight percent calcium and about 4 to 8 weight percent of nickel or copper, balance magnesium.

2. The alloy of claim 1 containing about 6.0 weight percent calcium and about 6.0 weight percent copper, balance magnesium.

3. The alloy of claim 1 containing about 10.5 weight percent calcium and about 6.0 weight percent copper, balance magnesium.

4. The alloy of claim 1 containing about 14.0 weight percent calcium and about 6.0 weight percent copper, balance magnesium.

5. The alloy of claim 1 containing about 6.0 weight percent calcium and about 5.6 weight percent nickel, balance magnesium.

6. The alloy of claim 1 containing about 10.5 weight percent calcium and about 5.6 weight percent nickel, balance magnesium.

7. The alloy of claim 1 containing about 14.0 weight percent calcium and about 5.6 weight percent nickel, balance magnesium.

8. The method for producing a magnesium alloy article which comprises the steps of providing a rapidly solidified product consisting essentially of about 6 to 14 weight percent calcium, about 4 to 8 weight percent nickel or copper, balance magnesium having a maximum average thickness of about 200 microns in at least one dimension, introducing the rapidly solidified product. into a mold, and consolidating the rapidly solidified product to obtain a desired densification of said rapidly solidified product.

9. The method of claim 8 wherein consolidation is carried out by hot isostatic pressing at a pressure of about 100 to 300 MPa and a temperature of about 150° to 350° C. for a time sufficient to obtain a desired densification of said rapidly solidified product.

10. The method of claim 8 wherein consolidation is carried out by extrusion using an extrusion ratio in the range of about 10:1 to 30:1 and a temperature of about 150° to 350° C.

* * * * *